US006974842B1

(12) United States Patent
Spena et al.

(10) Patent No.: US 6,974,842 B1
(45) Date of Patent: Dec. 13, 2005

(54) PROCESS FOR CATALYST RECOVERY FROM A SLURRY CONTAINING RESIDUAL HYDROCARBONS

(75) Inventors: Michael D. Spena, Katy, TX (US); Doug S. Jack, Ponca City, OK (US); Dan Fraenkel, Boulder, CO (US)

(73) Assignee: ConocoPhillips Company, Houston, TX (US)

( * ) Notice: Subject to any disclaimer, the term of this patent is extended or adjusted under 35 U.S.C. 154(b) by 0 days.

(21) Appl. No.: 10/994,506

(22) Filed: Nov. 22, 2004

(51) Int. Cl.[7] ..... C07C 27/00
(52) U.S. Cl. ..... 518/700; 518/709; 518/710; 518/715
(58) Field of Search ..... 518/700, 709, 518/710, 715

(56) References Cited

U.S. PATENT DOCUMENTS

| | | | | |
|---|---|---|---|---|
| 6,402,989 | B1 | 6/2002 | Gaffney | |
| 6,409,940 | B1 | 6/2002 | Gaffney et al. | |
| 6,461,539 | B1 | 10/2002 | Gaffney | |
| 6,630,078 | B2 | 10/2003 | Kourtakis et al. | |
| 6,635,191 | B2 | 10/2003 | Figueroa et al. | |
| 6,812,179 | B2 | 11/2004 | Huang et al. | 502/41 |
| 2002/0115730 | A1 | 8/2002 | Allison et al. | |

OTHER PUBLICATIONS

Bharadwaj, S.S., et al., "Catalytic Partial Oxidation of Natural Gas to Syngas," Fuel Processing Technology, 1995, vol. 42, pp. 109-127.

Choudhary, V.R., et al., "Large Enhancement in Methane-to-Syngas Conversion Activity of Supported Ni Catalysts Due to Precoating of Catalyst Supports with MgO, CaO or Rare-Earth Oxide," Catalysis Letters, 1995, vol. 32, pp. 387-390.

Hu, Yun Hang, et al., "Binary MgO-Based Solid Solution Catalysts for Methane Conversion to Syngas," Catalysis Reviews—Science and Engineering, 2002, vol. 44(3), pp. 423-453.

Sie, S.T., et al., "Fundamentals and Selection of Advanced Fischer-Tropsch Reactors," Applied Catalysis A: General. 1999, vol. 186, pp. 55-70.

*Primary Examiner*—J. Parsa
(74) *Attorney, Agent, or Firm*—Conley Rose P.C.

(57) ABSTRACT

In a system and method for recovering a catalyst, a slurry comprising said catalyst and residual hydrocarbons is heated so as to vaporize hydrocarbons. The vaporized hydrocarbons are separated from the catalyst. The separated catalyst is preferably further contacted with a stripping medium so as to further remove remaining hydrocarbons. In an embodiment, the catalyst is a Fischer-Tropsch catalyst contained in a reactor, preferably a slurry bubble reactor. In some embodiments, the slurry is diluted with additional hydrocarbons, and the residual hydrocarbons comprise waxy hydrocarbons. In an embodiment, substantially all of the hydrocarbons in the slurry are vaporized. In an embodiment, the catalyst is separated from the vaporized hydrocarbons via centrifugation. In an embodiment, substantially all of the hydrocarbons are removed from the catalyst.

52 Claims, 2 Drawing Sheets

Fig. 1
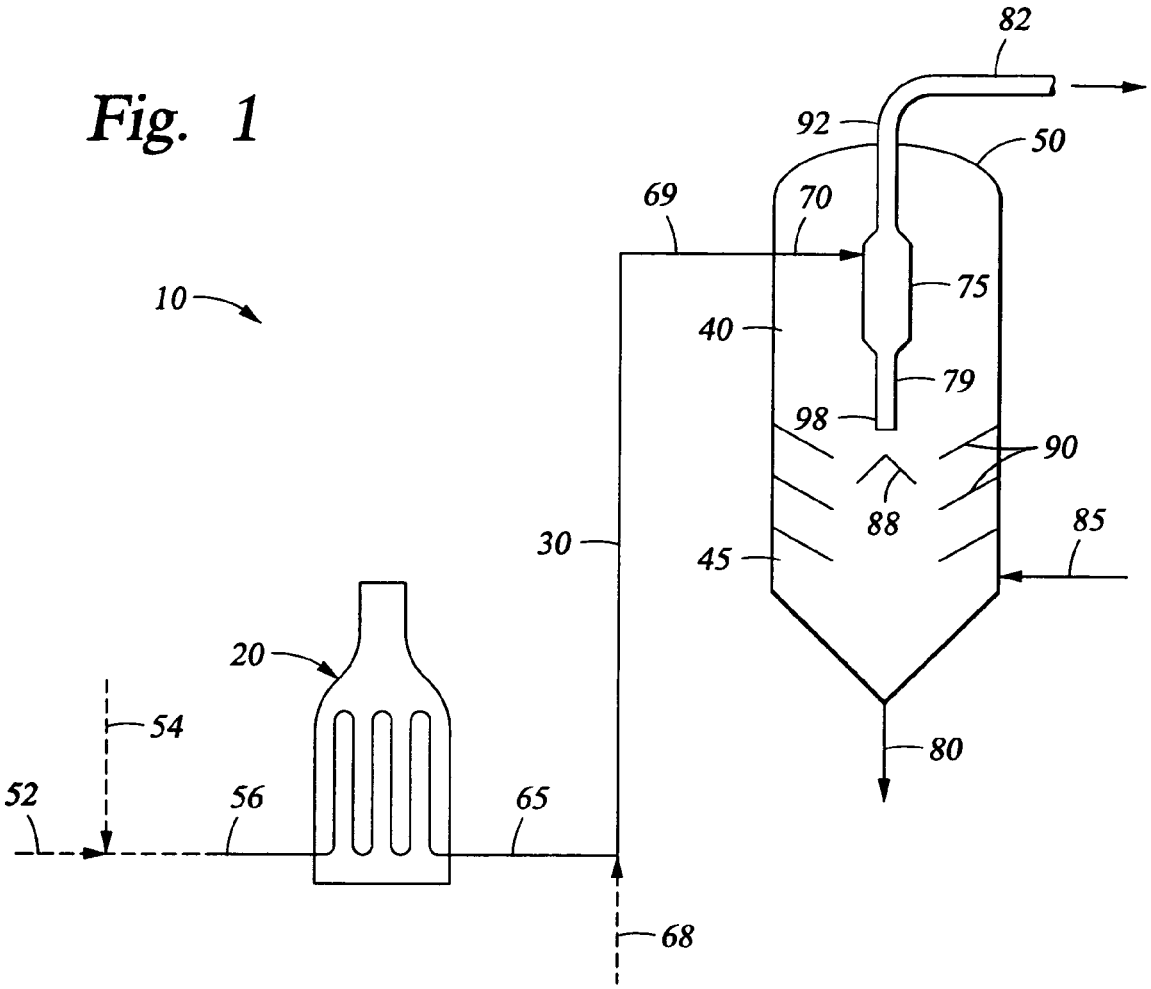
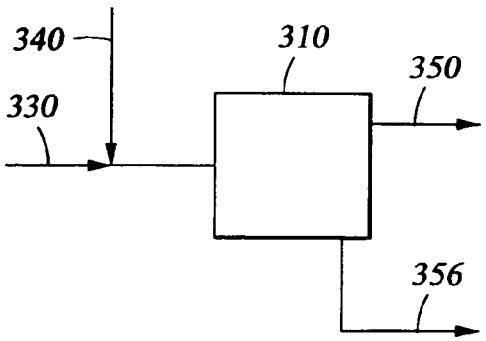
Fig. 4A
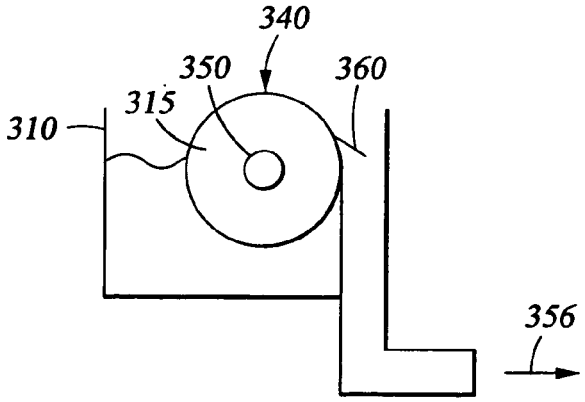
Fig. 4B

PROCESS FOR CATALYST RECOVERY FROM A SLURRY CONTAINING RESIDUAL HYDROCARBONS

CROSS-REFERENCE TO RELATED APPLICATIONS

This application is related to U.S. patent application Ser. No. 10/994,428 filed concurrently herewith and entitled "A Multi-Staged Wax Displacement Process for Catalyst Recovery from a Slurry," which is incorporated by reference herein in its entirety.

FIELD OF THE INVENTION

This invention generally relates to the reclamation of a solid catalyst, for example catalysts for use in a Fischer-Tropsch reaction. More specifically, the invention relates to a process for removing residual hydrocarbons from a metal catalyst by vaporizing a slurry of hydrocarbons and metal catalyst particles and separating off the hydrocarbon gas from the solid catalyst.

BACKGROUND OF THE INVENTION

Natural gas, found in deposits in the earth, is an abundant energy resource. For example, natural gas commonly serves as a fuel for heating, cooking, and power generation, among other things. The process of obtaining natural gas from an earth formation typically includes drilling a well into the formation. Wells that provide natural gas are often remote from locations with a demand for the consumption of the natural gas.

Thus, natural gas is conventionally transported large distances from the wellhead to commercial destinations in pipelines. This transportation presents technological challenges due in part to the large volume occupied by a gas. Because the volume of a gas is so much greater than the volume of a liquid containing the same number of gas molecules, the process of transporting natural gas over very long distances typically includes chilling and/or pressurizing the natural gas at or near the natural gas well in order to liquefy it. However, this contributes to the final cost of the natural gas.

Further, naturally occurring sources of crude oil used for liquid fuels such as gasoline and middle distillates have been decreasing and supplies are not expected to meet demand in the coming years. Middle distillates typically include heating oil, jet fuel, diesel fuel, and kerosene. Fuels that are liquid under standard atmospheric conditions have the advantage that in addition to their value, they can be transported more easily in a pipeline than natural gas, since they do not require energy, equipment, and expense required for natural gas liquefaction.

Thus, for all of the above-described reasons, there has been interest in developing technologies for converting natural gas to more readily transportable liquid fuels, i.e. to fuels that are liquid at standard temperatures and pressures. One method for converting natural gas to liquid fuels involves two sequential chemical transformations. In the first transformation, natural gas or methane, the major chemical component of natural gas, is reacted with oxygen to form syngas, which is a combination of carbon monoxide gas and hydrogen gas. In the second transformation, known as the Fischer-Tropsch process, carbon monoxide is reacted with hydrogen to form organic molecules containing carbon and hydrogen. Those organic molecules containing only carbon and hydrogen are known as hydrocarbons. In addition, other organic molecules containing oxygen in addition to carbon and hydrogen known as oxygenates may be formed during the Fischer-Tropsch process. Hydrocarbons having carbons linked in a straight chain are known as aliphatic hydrocarbons that may include paraffins and/or olefins. Paraffins are particularly desirable as the basis of synthetic diesel fuel.

Typically the Fischer-Tropsch product stream contains hydrocarbons having a range of numbers of carbon atoms, and thus having a range of molecular weights. Thus, the Fischer-Tropsch products produced by conversion of natural gas commonly contain a range of hydrocarbons including gases, liquids and waxes. Depending on the molecular weight product distribution, different Fischer-Tropsch product mixtures are ideally suited to different uses. For example, Fischer-Tropsch product mixtures containing liquids may be processed to yield gasoline, as well as heavier middle distillates. Hydrocarbon waxes may be subjected to an additional processing step for conversion to liquid and/or gaseous hydrocarbons. Thus, in the production of a Fischer-Tropsch product stream for processing to a fuel it is desirable to maximize the production of high value liquid hydrocarbons, such as hydrocarbons with at least 5 carbon atoms per hydrocarbon molecule ($C_{5+}$ hydrocarbons).

The Fischer-Tropsch process is commonly facilitated by a catalyst. Catalysts desirably have the function of increasing the rate of a reaction without being consumed by the reaction. A feed containing carbon monoxide and hydrogen is typically contacted with a catalyst in a reaction zone that may include one or more reactors.

Common reactors include packed bed (also termed fixed bed) reactors, fluidized bed reactors and slurry bed reactors. Originally, the Fischer-Tropsch synthesis was carried out in packed bed reactors. These reactors have several drawbacks, such as temperature control, that can be overcome by gas-agitated slurry reactors or slurry bubble column reactors. Gas-agitated multiphase reactors sometimes called "slurry reactors" or "slurry bubble columns," operate by suspending catalytic particles in liquid and feeding gas reactants into the bottom of the reactor through a gas distributor, which produces gas bubbles. As the gas bubbles rise through the reactor, the reactants are absorbed into the liquid and diffuse to the catalyst where, depending on the catalyst system, they are typically converted to gaseous and liquid products. The gaseous products formed enter the gas bubbles and are collected at the top of the reactor. Liquid products are recovered from the suspending liquid by using different techniques like filtration, settling, hydrocyclones, magnetic techniques, etc. Gas-agitated multiphase reactors or slurry bubble column reactors (SBCRs) inherently have very high heat transfer rates, and therefore, reduced reactor cost. This, and the ability to remove and add catalyst online are some of the principal advantages of such reactors as applied to the exothermic Fischer-Tropsch synthesis. Sie and Krishna (Applied Catalysis A: General 1999, 186, p. 55), incorporated herein by reference in its entirety, give a history of the development of various Fischer Tropsch reactors.

Typically, in the Fischer-Tropsch synthesis, the distribution of weights that is observed such as for $C_{5+}$ hydrocarbons, can be described by likening the Fischer-Tropsch reaction to a polymerization reaction with an Anderson-Shultz-Flory chain growth probability (a) that is independent of the number of carbon atoms in the lengthening molecule. $\alpha$ is typically interpreted as the ratio of the mole fraction of $C_{n+1}$ product to the mole fraction of $C_n$ product. A value of α of at least 0.72 is preferred for producing high carbon-length hydrocarbons, such as those of diesel fractions.

The composition of a catalyst influences the relative amounts of hydrocarbons obtained from a Fischer-Tropsch catalytic process. Common catalysts for use in the Fischer-Tropsch process contain at least one metal from Groups 8, 9, or 10 of the Periodic Table (in the new IUPAC notation, which is used throughout the present specification).

Cobalt metal is particularly desirable in catalysts used in converting natural gas to heavy hydrocarbons suitable for the production of diesel fuel. Alternatively, iron, nickel, and ruthenium have been used in Fischer-Tropsch catalysts. Nickel catalysts favor termination and are useful for aiding the selective production of methane from syngas. Iron has the advantage of being readily available and relatively inexpensive but the disadvantage of a high water-gas shift activity by which carbon monoxide, instead of reacting with hydrogen to produce hydrocarbons, is rejected from the system as the undesired carbon dioxide while forming, rather than consuming, hydrogen (from the water). Ruthenium has the advantage of high activity but is quite expensive and insufficiently abundant.

Many petroleum and chemical processes use particularized catalysts for the conversion of a feedstock to one or more desired products, such as the Fischer-Tropsch process described herein. In any reaction requiring a catalyst, the catalyst can be expected to have a certain life, for example several months to a few years. Accordingly, as the time on stream increases the catalyst tends to degrade, and eventually becomes ineffective. The spent catalyst or a portion of the spent catalyst can be removed from a reactor vessel, and in order to maintain catalyst inventory into the reactor, new and/or regenerated catalyst can be loaded therein. The selection depends largely on the cost of manufacture of the catalyst and the ability for the catalyst activity to be restored. The removed spent catalyst can undergo a regeneration process if the activity of the spent catalyst removed from the reactor vessel can be at least partially restored. However, in some cases the loss of catalyst activity is irreversible and the spent catalyst can undergo a reclamation process to recover the valuable materials. While such reclamation processes may be located on site, they are often off site such that the spent catalyst must be transported for processing. In such cases, it is preferable to remove any residual hydrocarbonaceous products from the spent catalyst prior to processing the spent catalyst in order to recover the value of the hydrocarbonaceous products, avoid the additional transportation costs associated with the weight of the residual hydrocarbons, and minimize the presence of hydrocarbonaceous compounds in any waste materials for environmental conservation reasons. Therefore, a need exists in the art for efficient methods and systems for the removal of residual hydrocarbons from catalysts, and in particular Fischer-Tropsch catalysts that are used in large quantities, to facilitate the reclamation of such catalysts.

SUMMARY OF THE INVENTION

The invention relates to a process for recovering a solid catalyst from a catalyst slurry comprising residual hydrocarbons, said process comprising (a) providing a catalyst slurry feedstream comprising catalyst particles and residual hydrocarbons; (b) passing said catalyst slurry feedstream through a heater so as to vaporize a substantial portion of the residual hydrocarbons; (c) conveying the heated slurry feedstream comprising vaporized hydrocarbons and catalyst particles in a riser to a disengaging zone; (d) separating substantially most of the catalyst particles from the vaporized hydrocarbons in the disengaging zone; (e) providing a stripping zone in fluid communication with the disengaging zone, said stripping zone suitably located so as to receive the separated catalyst particles of step (d) from the disengaging zone; (f) supplying a stripping medium in the stripping zone; (g) contacting separated catalyst particles in the stripping zone with the stripping medium to remove some strippable hydrocarbons remaining after separation step (d) from the separated catalyst particles to produce stripped catalyst particles; (h) recovering an effluent stream comprising vaporized hydrocarbons, strippable hydrocarbons, and stripping medium at one end of the disengaging zone; and (i) recovering the stripped catalyst particles at another end of the stripping zone.

The invention further relates to a system for recovering a solid catalyst from a slurry stream, comprising (a) a heater configured for receiving a slurry stream comprising solid catalyst particles and residual hydrocarbons and vaporizing most of the hydrocarbons therein; (b) a disengaging zone comprising a gas/solid separation unit, said disengaging zone configured for receiving and separating the vaporized hydrocarbons from the solid catalyst; (c) a stripping zone in fluid communication with the disengaging zone, said stripping zone suitably located so as to receive the separated catalyst particles from the disengaging zone, and stripping any remaining hydrocarbons therefrom by contact with a stripping medium; and (d) a riser having one end connected to the heater and another end connected to the gas/solid separation unit for conveying catalyst particles and vaporized hydrocarbons from the heater to the separation vessel.

Another embodiment of the present invention relates to an integrated process for producing hydrocarbons, comprising contacting a solid synthesis catalyst with a gas stream comprising carbon monoxide and hydrogen in a reaction zone under conversion promoting conditions to convert at least a portion of said gas stream so as to produce one or more hydrocarbons while deactivating at least a portion of said solid synthesis catalyst; removing all or a portion of the solid synthesis catalyst from the reaction zone so as to generate a slurry feedstream comprising spent solid synthesis catalyst and residual hydrocarbons; optionally, means of adjusting the hydrocarbon composition of said slurry feedstream, the catalyst content of said slurry feedstream or combination thereof; and employing the process for recovering a solid catalyst from a catalyst slurry comprising residual hydrocarbons disclosed herein.

These and other embodiments, features and advantages of the present invention will become apparent with reference to the following detailed description and drawings.

BRIEF DESCRIPTION OF THE DRAWINGS

The invention, together with further advantages thereof, may best be understood by reference to the following description taken in conjunction with the accompanying drawings in which:

FIG. 1 is a process flow diagram of an embodiment of a catalyst recovery process according to the present invention comprising a heater, a riser, a disengaging zone including a cyclone and a stripping zone, wherein a solid catalyst is separated from waxy hydrocarbons in a catalyst slurry stream by vaporization means and gas-solid separation;

FIG. 4 illustrates yet another alternate embodiment for a means of providing a catalyst slurry stream to the catalyst recovery process according to the present invention, said means comprising a solid-liquid separation unit.

DETAILED DESCRIPTION OF THE PREFERRED EMBODIMENTS

Figure 2:
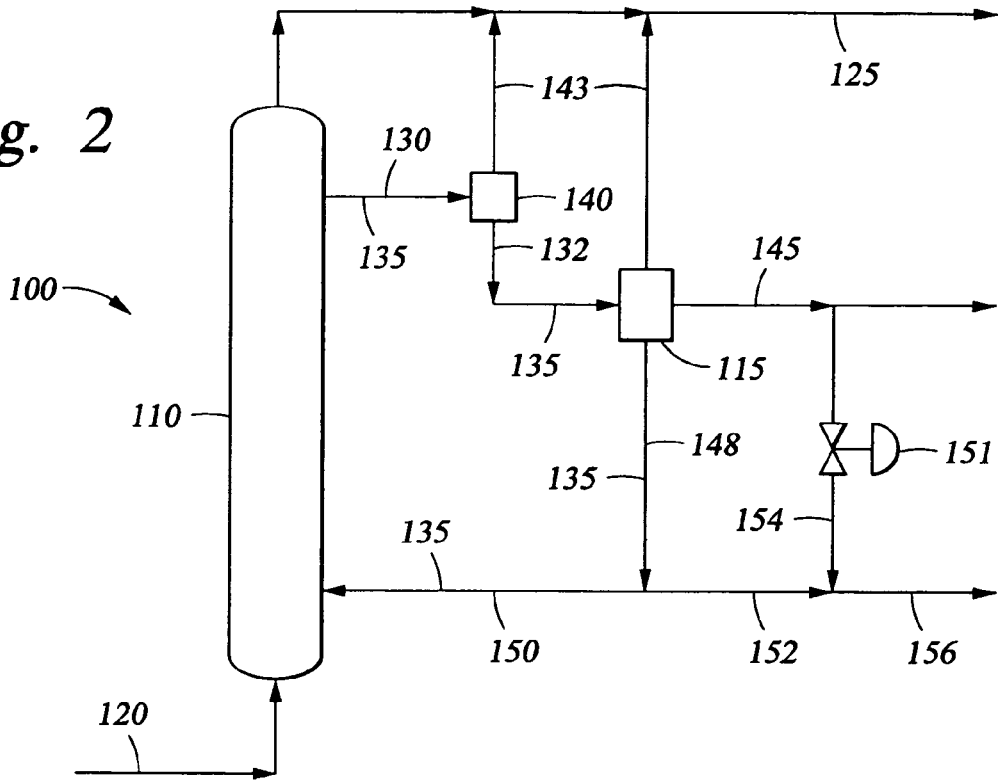
FIG. 2 illustrates embodiments of different means of providing a catalyst slurry stream to the catalyst recovery process according to the present invention, said means comprising a catalytic reaction system and/or a solid-liquid separation unit connected to said catalytic reaction system.

In the description that follows, like parts are marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness. The present invention is susceptible to embodiments of different forms. There are shown in the drawings, and herein will be described in detail, specific embodiments of the present invention with the understanding that the present disclosure is to be considered an exemplification of the principles of the invention, and is not intended to limit the invention to that illustrated and described herein. It is to be fully recognized that the different teachings of the embodiments discussed below may be employed separately or in any suitable combination to produce desired results. Specifically, the wax vaporization/separation and catalyst recovery process and system of the present invention may be used with any suitable catalyzed synthesis reaction wherein the catalyst needs to be cleaned of residual hydrocarbons prior to subsequent processing. In a preferred embodiment, the wax vaporization/separation and catalyst recovery process and system of the present invention is integrated with a synthesis reaction for producing gas, liquid, and waxy hydrocarbons from synthesis gas, for example a Fischer-Tropsch synthesis reaction or by an alcohol (e.g., methanol) synthesis reaction. The most preferred embodiment is the integration of the waxy hydrocarbon vaporization/separation and catalyst recovery process and system of the present invention with a Fischer-Tropsch synthesis reaction for converting synthesis gas to preferably liquid and waxy hydrocarbons via contact with a Fischer-Tropsch catalyst. The remainder of the detailed description will focus on this preferred embodiment with the understanding that the present invention may have broader applications.

In an embodiment shown in FIG. 1, a system 10 for recovering a solid catalyst comprises a heater 20, a riser 30, a disengaging zone 40, and a stripping zone 45. In a preferred embodiment of the present invention illustrated in FIG. 1, the disengaging zone 40 and a stripping zone 45 are contained within a single vessel 50.

The heater 20 is configured for receiving a slurry feedstream 56, wherein the slurry stream comprises catalyst particles and residual hydrocarbons, wherein the catalyst particles are dispersed in a hydrocarbon liquid. Providing said slurry feedstream 56 comprises withdrawing a catalyst-containing slurry stream from a reaction vessel, preferably a slurry bubble column reactor, more preferably a slurry bubble column Fischer-Tropsch reactor. Providing said slurry feedstream 56 depends largely on how the composition of a catalyst-containing slurry stream withdrawn from a reaction vessel can be adjusted. Hence, in order to provide at least a portion of slurry feedstream 56, a catalyst-containing slurry stream may be provided directly 'as is' from a reaction vessel or alternatively, a catalyst-containing slurry stream withdrawn from a reaction vessel may be passed through a liquid/solid separation unit and/or a liquid-liquid extraction unit so as to change its solid content, the composition of the dispersing hydrocarbon liquid, the residual hydrocarbon content, or any combinations thereof. Some different possible means for providing the slurry feedstream 56 to system 10 are described herein and some of these means are illustrated in FIGS. 1, 2, 3, 4*a* and 4*b*.

One means for providing slurry feedstream 56 or a portion of slurry feedstream 56 is illustrated in an optional embodiment of FIG. 1, i.e., the slurry feedstream 56 may be formed by combining a hydrocarbon liquid stream 54 and a slurry stream 52 derived from a synthesis reactor, such as from a Fischer-Tropsch reactor (as will be illustrated in FIG. 2 and described later). The combination of streams 52 and 54 to form slurry feedstream 56 may be performed to adjust the solid catalyst content of the resulting slurry feedstream 56 and/or the temperature to be within a more desirable range for the slurry feedstream 56 prior to entering heater 20. By the optional addition of a hydrocarbon liquid stream 54 to slurry stream 52, the catalyst weight content in resulting slurry feedstream 56 can be reduced to between about 5 percent by weight (wt %) and about 30% of the total weight of the slurry, preferably between about 10 wt % and about 20 wt %. Slurry stream 52 may be provided continuously from a hydrocarbon synthesis process (such as a process employing Fischer-Tropsch synthesis), or may be provided in a batch mode or semi-batch mode, for example from one or more storage tanks or holding tanks. Stream 52 may be provided from one hydrocarbon synthesis reactor or a plurality of reactors. Slurry stream 52 preferably comprises catalyst particles disposed in waxy hydrocarbon liquid. The weight of catalyst in stream 52 typically comprises from about 10 to about 40% of the total weight of the slurry. Slurry stream 52 typically has a temperature sufficiently high to maintain its waxy hydrocarbon components in a molten state. Slurry stream 52 typically has a temperature of about 200° F. to about 550° F. (about 90–290° C.). Hydrocarbon liquid stream 54 added to dilute slurry stream 52 to form slurry feedstream 56 is preferably characterized by a temperature such as to prevent crystallization of waxy components in slurry feedstream 56. Preferably, hydrocarbon liquid stream 54 is characterized by a temperature at or above that of slurry stream 52 before combining with slurry stream 52 to form slurry feedstream 56. If the hydrocarbon liquid stream 54 to be added to slurry stream 52 has a temperature below the desired temperature range, hydrocarbon liquid stream 54 may be preheated, for example, with steam, by heat exchange with another process stream, or by any other suitable means for increasing the temperature of slurry stream 54 within a desirable range. Preferably, the temperature of both slurry streams 52 and 56 is maintained so as to prevent crystallization of waxy components. The additional hydrocarbon liquid stream 54 may be also added to slurry stream 52 to improve the transportability of the slurry feedstream 56 to heater 20 and/or and to ensure sufficient gas flow upon vaporization to prevent and/or minimize potential coke plugging and tube degradation inside heater 20 from abrasion by entrained catalyst particles. Furthermore, the resulting larger volume of gas ensures that the catalyst particles will be carried upwards in riser 30 to the downstream disengaging zone 40. Additionally, a gas stream, which preferably should comprise water (steam), hydrogen gas, or mixtures thereof, may be added (not illustrated) to slurry feedstream 56 prior to entering heater 20 so as to minimize coking in heater 20.

Hydrocarbon liquid stream 54 preferably comprises hydrocarbonaceous compounds having a carbon number greater than about 10 and/or having a boiling point greater than about 350° F. (about 175° C.), and said hydrocarbonaceous compounds may be selected from any suitable source such as a fraction or portion of a Fischer-Tropsch liquid product from one or more Fischer-Tropsch reactors; a liquid fraction from a product upgrading unit; or any other hydrocarbon stream in the $C_{10+}$ range, preferably in the $C_{10}$ to $C_{30}$ range. Heavy hydrocarbons, such as Fischer-Tropsch wax hydrocarbons (with a 5% boiling range greater than about 640° F., i.e., about 340° C.) and/or heavy diesel hydrocarbons (with a 5% boiling range greater than about 500° F., i.e., about 260° C.), are preferred for diluting slurry stream 52 because of their potential to thermally crack during the vaporization step in heater 20. Indeed, thermal cracking may take place in heater 20, and thermal cracking of heavy hydrocarbons will likely generate additional valuable middle distillate products, in contrast to the use of lighter hydrocarbons, such as comprised in naphtha boiling range (between about 70° F. and about 350° F.), for dilution of the slurry with lighter hydrocarbons would likely result in some thermal cracking at a high temperature to produce less desirable $C_1$–$C_4$ hydrocarbons (including alkanes and alkenes), such as butane and methane. Preferably, liquid hydrocarbon stream 54 comprises at least a portion of or a fraction of a Fischer-Tropsch liquid product.

In some alternate embodiments for FIG. 1, slurry stream 52 comprises a solid catalyst containing adsorbed residual hydrocarbons and being dispersed in a hydrocarbon liquid, wherein the dispersing hydrocarbon liquid contains a diesel and/or naphtha cut for example a synthetic naphtha or diesel fraction from a Fischer-Tropsch synthesis process. In such a case, the slurry stream 52 may not need to be diluted further by liquid hydrocarbon stream 54. The concepts of the present invention are not limited however to using Fischer-Tropsch liquid products and can be used with any hydrocarbon liquid exhibiting beneficial properties taken from any readily available source, including product storage tanks if necessary.

Alternatively, slurry stream 52 may directly serve as slurry feedstream 56 or a portion of slurry feedstream 56 to heater 20 if its catalyst content and its flowability is suitable to be fed directly to heater 20. If slurry stream 52 serving as at least a portion of feedstream 56 (without dilution with stream 54) has a temperature below the desired temperature range, slurry stream 52 may be preheated, for example, by heat exchange with steam or/and any hot process stream, or by a preheating (radiant-heat furnace) unit.

One alternate method for providing slurry feedstream 56 or a portion of slurry feedstream 56 is illustrated in FIG. 2. FIG. 2 illustrates a Fischer-Tropsch process 100 comprising Fischer-Tropsch reactor 110, and catalyst-hydrocarbon separation unit 115. Fischer-Tropsch reactor 110 preferably is a slurry bed reactor. Slurry bed reactors are known in the art and are also referred to as "slurry reactors" or "slurry bubble columns." Fischer-Tropsch reactor 110 operates by suspending solid particles of a Fischer-Tropsch catalyst in a liquid inside a reactor vessel, thereby forming a slurry, which typically comprises between 5 percent by weight (wt %) and about 40 wt % of solid catalyst particles in a liquid which comprises hydrocarbons. At least a portion of the slurry comprising the Fischer-Tropsch catalyst and hydrocarbons exits the Fischer-Tropsch reactor 110 as reactor slurry stream 130 (typically but not necessarily at an exit point in the top half of the reactor vessel) to an external slurry circulation loop 135. The external slurry circulation loop 135 preferably comprises reactor slurry stream 130, optionally a gas disengagement unit 140, optionally degassed slurry stream 132, catalyst-hydrocarbon separation unit 115, hydrocarbon product stream 145, and solid-enriched slurry stream 148. Reactor slurry stream 130 typically comprises solid catalyst and synthesized hydrocarbon products, as well as entrapped gas. Reactor slurry stream 130 may be passed through the optional gas-disengaging zone 140 to separate entrapped gas from the slurry and form a degassed slurry stream 132 and gas effluent 143. Reactor slurry stream 130 (or optionally degassed slurry stream 132) is passed through catalyst-hydrocarbon separation unit 115 so as to form hydrocarbon product stream 145 and solid-enriched slurry stream 148. Catalyst-hydrocarbon separation unit 115 can be any solid-liquid separation system, which can provide a liquid product stream (i.e., 145) which is catalyst-lean or substantially free of catalyst solid and a catalyst-rich slurry stream (i.e., 148). Catalyst-hydrocarbon separation unit 115 may employ one or more solid-liquid separation techniques such as filtration, decantation, sedimentation, centrifugation, magnetic separation, or any combination thereof. Catalyst-hydrocarbon separation unit 115 preferably comprises a settler, a filter, a hydrocyclone, a centrifuge, a magnetic separation unit, any plurality thereof, or any combination thereof. In preferred embodiments, catalyst-hydrocarbon separation unit 115 comprises a settler, a filter, any plurality thereof, or any combination thereof.

Under typical reactor operating conditions, the catalyst-enriched slurry stream 148 would be recycled almost entirely to Fischer-Tropsch reactor 110. However, when it is desired to remove all or a portion of the catalyst-enriched slurry stream 148 for catalyst reclamation, the slurry stream 148 is either diverted to the catalyst recovery facility 10, completely (not shown) or partially via stream 152 as shown in FIG. 1. A portion 150 (i.e., a slipstream) of solid-enriched slurry stream 148 may be recycled to reactor 110, while the portion 152 can provide in part or in totality the slurry feedstream 56 or the slurry stream 52 to the catalyst recovery facility 10 as shown in FIG. 1. Further, when the catalyst/liquid volume in Fischer-Tropsch reactor 110 declines to the point where the slurry can no longer provide a slurry stream 130, the slurry may be allowed to exit Fischer-Tropsch reactor 110 from stream 150 instead (not shown) but in reverse direction to provide, in part or in totality, the slurry feedstream 56 or alternatively the slurry stream 52 to the catalyst recovery facility 10 as shown in FIG. 1. In one embodiment shown in FIG. 2, a portion 154 of Fischer-Tropsch product stream 145 is diverted and combined to slurry stream 152 containing catalyst particles and residual waxy hydrocarbons to form slurry stream 156. The flow rate of portion 154 of product stream 145 may be regulated by a valve 151. Slurry stream 156 can provide, in part or in totality, the slurry feedstream 56 to the catalyst recovery facility 10 of FIG. 1.

Although not illustrated in FIG. 2, a yet alternate method for providing slurry feedstream 56 or a portion of slurry feedstream 56 can be achieved by unloading the content of Fischer-Tropsch reactor 110, either partially or in totality. In this embodiment, Fischer-Tropsch reactor 110 preferably comprises a slurry bubble column reactor, said reactor containing a slurry comprising a solid catalyst and a molten waxy hydrocarbon liquid, wherein the solid catalyst is at least partially deactivated and is dispersed in the molten waxy hydrocarbon liquid. The Fischer-Tropsch reactor 110, when operating, is typically at a reaction temperature between 160° C. and 300° C., preferably between 190° C. and 260° C., more preferably between 205° C. to 230° C. When the reactor shutdown is commenced, the composition of gas feedstream 120 may be modified such as by substituting one or both of the reactant gases by another unreactive gas like methane, natural gas or other suitable gaseous stream, or by removing one of the reactant gases, so as to stop the reaction in Fischer-Tropsch reactor 110. Alternatively or in addition, the slurry within reactor 110 may be cooled from the reaction temperature to a lower temperature so as to stop the reaction and make it more convenient to start the catalyst unloading process. The cooling may be intermittent or continuous. The cooling may commence before, during or after modifying the composition of the gas feedstream 120. The cooling of the slurry within reactor 110 however could cause solidification of some of the waxy hydrocarbon components. Therefore, alternatively or in addition, a lighter diluting hydrocarbon liquid (i.e., lighter in boiling range than molten waxy hydrocarbon liquid) may be added, either periodically or continuously, to reactor 110 so as to gradually lower the content in molten waxy hydrocarbons in the slurry contained in the reactor 110, while the slurry stream 130 continuously goes through external slurry circulation loop 135 and get separated in the liquid-solid separation unit 115. With the addition of the lighter diluting hydrocarbon liquid to the slurry in reactor 110, the cooling of the slurry may be excluded if the reaction in the slurry has been stopped by removing at least one or both of the reactant gases. The cooling of the slurry is preferably performed. The reactor may comprise internal coils or tubes disposed within the slurry, and the cooling of the slurry is performed by passing a cooling medium through the internal coils or tubes to remove some of the heat from the slurry and thereby decreasing its temperature. Cooling may be done before, during or after the addition of the lighter diluting hydrocarbon liquid. Cooling may be done after modification of gas feed composition but before the addition of the lighter diluting hydrocarbon liquid. The waxy hydrocarbon liquid in hydrocarbon product stream 145 and in solid-enriched slurry stream 148 is gradually replaced by the lighter diluting hydrocarbon liquid. The solid-enriched slurry stream 148 preferably in its entirety is recycled to reactor 110 such that a majority of the wax in the slurry present in reactor 110 is replaced by the introduced diluting hydrocarbon liquid and up to a point at which the slurry can achieve an acceptable temperature without causing solidification of the newly-combined wax-reduced slurry. The acceptable temperature may range from ambient temperature to about 160° C., preferably from ambient temperature to about 120° C. Once the slurry within reactor 110 achieves the acceptable temperature, the addition of diluting hydrocarbon liquid to the reactor vessel can be stopped. After the acceptable temperature is reached, the newly-combined wax-reduced slurry in reactor 110 can then be withdrawn via stream 130 and/or stream 150 (in reverse flow) so as to provide, in part or in totality, the slurry feedstream 56 to the catalyst recovery facility 10 of FIG. 1, which comprises a liquid-solid separation unit. The newly-combined wax-reduced slurry in reactor 110, either as a portion of the reactor content or as the totality of reactor content, can be sent via a wax-reduced slurry stream to a holding vessel (or more than one holding vessels) prior to being fed to the catalyst recovery facility 10 of FIG. 1. The holding vessel may comprise heating so as to maintain the temperature of wax-reduced slurry at or above about the acceptable temperature without causing solidification of the wax-reduced slurry. The optional holding vessel may be heated to keep in a molten state wax hydrocarbons present in the wax-reduced slurry as well as the wax hydrocarbons onto and/or into the solid catalyst. In addition, the wax-reduced slurry contained in the holding vessel is preferably agitated in order to keep the solid catalyst dispersed in the wax-reduced slurry so as to prevent the solid catalyst from settling to the bottom of the holding vessel. The agitation may be provided by supplying a fluidization gas to the bottom of the vessel(s) and/or by continuously circulating a portion of the vessel content (so as to create fluid turbulence within the vessel), for example with a re-circulating pump (not shown). The holding vessel may further comprise a fluidization gas inlet located at or near the bottom of said vessel(s) and configured to pass the fluidization gas through the wax-reduced slurry disposed in the holding vessel. The fluidization gas should have a gas velocity sufficient to maintain the catalyst solids in suspension in the wax-reduced slurry contained in the holding vessel. It should be noted that, while the diluting lighter hydrocarbon liquid is continually added to reactor 110 and the portion 150 of solid-enriched slurry stream 148 is returned to reactor 110, product stream 145 comprising less and less waxy hydrocarbons (as stream 145 is gradually enriched in lighter diluting hydrocarbon liquid) is continuously removed from reactor 110 so as to prevent reactor liquid overflow.

Figure 3:
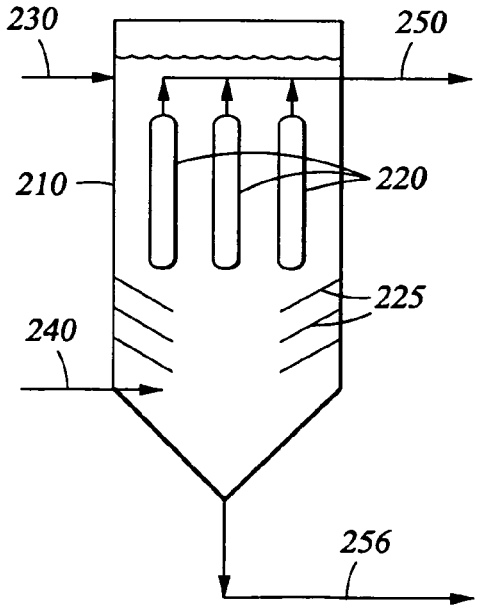
FIG. 3 illustrates one alternate embodiment for a means of providing a catalyst slurry stream for the catalyst recovery process according to the present invention, said means comprising a liquid-liquid extraction unit and a solid-liquid separation unit.

A yet alternate means for providing slurry feedstream 56 or a portion of slurry feedstream 56 is illustrated in FIG. 3. FIG. 3 illustrates a liquid-liquid extraction/separation unit 210. Extraction/separation unit 210 contains, in its upper end, a separation zone characterized by filtration units 220 and, in its lower end, a liquid-liquid extraction zone characterized by contacting plates 225. A slurry stream 230 (similar to the slurry stream 130 as described in FIG. 2) is fed to the upper end of extraction/separation unit 210 so that solid particles migrate downward through the separation zone, while an extraction medium 240 is fed in the lower end of extraction/separation unit 210 preferably below the location of contacting plates 225 within the extraction zone. Extraction/separation unit 210 should be designed to effect good liquid-liquid extraction of the slurry stream 230 by extraction medium 240. The catalyst particles and extraction medium 240 flow mainly in a counter-current manner in the extraction zone wherein the presence of contacting plates 225 should promote good contact between downward slurry flow and upward flow of extraction medium. The contact should be effective such that extraction medium 240 extracts some of the waxy hydrocarbon liquid from the slurry, particularly some of the residual hydrocarbons from the solid catalyst. The main purpose of the extraction medium 240 is to displace waxy hydrocarbon liquid from slurry stream 230 to the extraction medium so as to form a spent extraction medium (i.e., containing waxy hydrocarbons) which moves upwards into the separation zone of unit 210 and passes through filtration units 220. Extraction medium 240 preferably comprises an extraction liquid selected from the group consisting of a diesel, a naphtha, a gasoline, a kerosene, a gas oil, a heating oil, a solvent, and any combination thereof. Extraction medium 240 more preferably comprises a light hydrocarbon liquid such as naphtha and/or diesel, and most preferably, a synthetic light hydrocarbon liquid such as naphtha and/or diesel derived from a Fischer-Tropsch synthesis. A filtrate 250 exits filtration units 220, wherein filtrate 250 should be substantially free of solids and comprises said spent extraction medium (i.e., hydrocarbon-enriched extraction medium), while a retentate (not shown) exiting filtration units 220 is retained in unit 210. The extracted particles dispersed in a liquid containing some extraction medium exit unit 210 via slurry stream 256, which can provide, in part or in totality, the slurry feedstream 56 to the catalyst recovery facility 10 of FIG. 1.

Another means or method for providing slurry feedstream 56 is illustrated in FIGS. 4*a* and 4*b*. FIGS. 4*a* and 4*b* illustrate a rotary filtration unit 310. Rotary filtration unit 310 preferably comprises a rotary drum vacuum filter as shown as 315 in FIG. 4*b*. A rotary drum vacuum filter 315 can be operated in a continuous manner, wherein a slurry stream 330 (which may be the slurry stream 130 as described in FIG. 2) is separated by a porous substrate, such as cloth or other suitable media, which rotates through the slurry. A vacuum is applied to its inner surface to cause the solids to accumulate on its external surface and form a cake or solid layer through which a liquid hydrocarbon filtrate 350 is drawn. A vacuum is applied to its inner surface while the rotary drum vacuum filter 315 rotates so as to cause the solids from the slurry to accumulate on its external surface as a cake or solid layer through which a liquid hydrocarbon filtrate 350 is drawn. Rotary filtration unit 310 should be designed to effect the production of a stream enriched in catalyst particles. Additionally, rotary filtration unit 310 should be designed to clean the solid catalyst deposited on the filter medium by contacting the catalyst-containing cake with washing medium 340. Washing medium 340 preferably comprises a light hydrocarbon liquid such as naphtha and/or diesel, preferably Fischer-Tropsch naphtha, and its main purpose is to remove some of the residual hydrocarbons from the solid catalyst surface by displacement of the residual hydrocarbons from the catalyst surface to the washing medium. As the rotary drum vacuum filter 315 rotates while partially submerged in the slurry, vacuum draws the liquid filtrate (comprising the washing medium with the removed residual waxy hydrocarbon liquid) through the catalyst cake and filter medium on the drum. The filtrate 350 flows through internal pipes(s) (not shown) before exiting rotary drum vacuum filter 315. The rotary drum vacuum filter 315 can discharge its filtered and washed catalyst cake by means of several discharge arrangements, such as a scraper 360 (as shown in FIG. 4*b*), belt, or roll (not shown). The operation is typically cyclic and continuous, with each revolution of the drum 315 comprising cake formation, cake washing with liquid washing medium 340, optional drying, and cake discharge, so that filtrate 350 (catalyst-free) and a catalyst-enriched slurry 356 exit rotary filtration unit 310. Slurry stream 356 can provide, in part or in totality, the slurry feedstream 56 to the catalyst recovery facility 10 of FIG. 1.

Referring back to FIG. 1, slurry feedstream 56 typically comprises residual waxy hydrocarbons deposited on a solid catalyst, wherein the solid catalyst is dispersed in a hydrocarbon liquid (such as Fischer-Tropsch liquid products) and slurry feedstream 56 is provided by various means such as those described above. Slurry feedstream 56 is fed to heater 20 and is heated to a high temperature in heater 20, so as to vaporize a majority of the hydrocarbons from the slurry (residual hydrocarbons and hydrocarbons from the dispersing hydrocarbon liquid), preferably a substantial portion of the hydrocarbons from the slurry, so as to form a heater effluent 65. In various embodiments, equal to or greater than, 75, 80, 85, 90, 95, or 99 weight percent of the hydrocarbons are vaporized from the slurry. The heat supplied in heater 20 is typically sufficient to reach a gas temperature of about 400° F. to about 950° F., preferably of about 700° F. to about 950° F. at heater pressure. Heater effluent 65 comprises a mainly gas/solid mixture. There may be a small amount of unvaporized hydrocarbons in heater effluent 65, said unvaporized hydrocarbons being in small liquid droplets and/or remaining adsorbed to the solid catalyst after passing through heater 20. Some of the unvaporized hydrocarbons are strippable hydrocarbons; thus some of the unvaporized hydrocarbons can be stripped off in a later step downstream of said heater 20.

Heater 20 preferably comprises heater tubes (not shown) disposed inside a heating vessel. The slurry typically passes through heater 20 in the inside of the heater tubes while heat is provided on the outside of the tubes and transferred to said slurry to cause vaporization of the hydrocarbons present in the slurry. Preferably, heater 20 is designed and controlled to prevent coking in the heater tubes and to minimize tube degradation wherein the solid catalyst entrained in the hydrocarbon vapor could potentially erode the heater tubes through abrasive impact with the interior surface of the tubes. The heater 20 may be fueled by natural gas or preferably by a waste gas such as a tail gas stream exiting a unit reactor (e.g., a synthesis reactor), a distillation column in the facility, or gas such as ethane and/or propane for example as obtained from natural gas in a gas processing plant. In one embodiment illustrated in FIG. 2, all or a portion of tail gas stream 125 from synthesis reactor 110 can be used as primary or supplemental fuel to heater 20.

When heated in heater 20, preferably a substantial portion of the liquid in slurry feedstream 56 vaporizes. Additionally, thermal cracking of some of the hydrocarbons can occur. A hot, mostly two-phase gas/solid mixture exits wax heater 20 as heater effluent stream 65. Heater effluent stream 65 is fed to the inlet of riser 30. The pressure of heater effluent stream 65 may be reduced just before it enters riser 30 to aid in the flow of the gas contained herein.

Riser 30 is connected to heater 20 for conveying the gas/solid mixture to the disengaging zone 40. Riser 30 is preferably vertical and comprises a tubular unit. The vertical tubular riser is preferably elongated with a length-to-diameter ratio greater than 10:1, preferably greater than 20:1. In some embodiments, the diameter of the vertical riser 30 increases from the base to the top to expand the gas volume and slow the increasing gas velocity through the riser 30. However, the diameter of riser 30 is not required to change along the length of the riser. Preferably, the riser is designed to optimize and control the velocity of the vapor entraining the solid particles passing through it. The hydrocarbon vapor generated in heater 20 lifts the solid catalyst up in riser 30 so that a riser effluent stream 69 comprising mainly a two-phase gas/solid mixture exits riser 30 and feeds disengaging zone 40 via conduit 70. Riser effluent stream 69 is fed to an entry point at the top of disengaging zone 40, which is relatively located at a greater height than the discharge point of heater effluent stream 65 from heater 20. Therefore, riser 30 is typically needed to transport the gas/solid mixture from the discharge point of heater effluent stream 65 up to the desired entry point of the disengaging zone 40. The gas velocity in riser 30 preferably should be high enough to keep the catalyst particles in suspension as they are carried on up and over into the disengaging zone 40. Additionally, the gas velocity should be low enough to prevent eroding the interior walls of the riser 30, especially if no protective erosion-resistant layer covers the interior walls, as well as to allow for the proper residence time in the riser 30 for favoring additional cracking and/or vaporization of substantially all hydrocarbon liquid if desired. To prevent and/or minimize interior walls erosion, riser 30 is preferably lined with refractory material to confer thermal and mechanical stability to the riser interior.

The gas velocity in the riser preferably is at least about 20 feet per second (ft/s) and can be increased up to a velocity of about 500 ft/s at the riser exit. The velocity of the gas passing through riser 30 is preferably in a range of from about 20 to about 200 feet per second, preferably from about 30 to about 100 feet per second. The residence time of the gas in riser 30 should be between about 1 second to about 10 seconds, and is preferably between about 2 seconds to about 5 seconds. At the bottom end of riser 30 where heater effluent stream 65 is fed to riser 30, a supplemental transport gas 68 may be optionally added to accelerate the gas velocity in riser 30. The supplemental transport gas 68 may comprise liquid petroleum gas (LPG); hydrogen; steam; natural gas; any gaseous alkane such as, methane, ethane, propane, butane; a gas effluent from any unit within the proximity of the riser 30 or within the proximity of the solid catalyst recovery system 10, such as a tail gas from a Fischer-Tropsch reactor, from a hydroprocessing unit (hydrotreating, hydrocracking, and the like) or a gaseous fraction from a fractionation column; or any combination thereof. The supplemental transport gas 68 preferably comprises hydrogen; steam; or combination thereof. The pressure drop in riser 30 is typically between about 5 psi and about 15 psi.

The gas/solid mixture is conveyed up riser 30 and exits as stream 69 which is fed to disengaging zone 40. Disengaging zone 40 serves as the disengaging space for the separation of the catalyst particles and small liquid droplets from the vapor phase and serves as the housing for one or more direct-connected cyclones 75 or any other suitable cyclonic separation system. The disengaging zone 40 designed for the capture of small solid particles as well as small liquid droplets preferably employs at least one cyclone 75. Multiple cyclones 75 may be employed in disengaging zone 40. The number and size of the cyclones used in disengaging zone 40 depends upon the particle size and desired separation efficiency. Cyclones provide whirling motion and exert radial centrifugal force with a central low-pressure area to separate solid particles and liquid droplets from gas. The disengaging zone 40 preferably comprises an upper end and a lower end, the upper end having a tangential inlet horizontal conduit 70 in direct communication with the outlet end of the riser. Tangential inlet horizontal conduit 70 should feed the primarily two-phase gas/solid mixture in a tangential manner to cyclone 75 so as to create a vortex and separate solid particles as well as small liquid droplets from gas phase by the use of centrifugal force. Some of the gas keeps the catalyst in motion and travels down cyclone diplegs 79 with the catalyst particles. The separated catalyst particles settle downward in the cyclone hopper sections 78 at the base of cyclone diplegs 79. The lower end of disengaging zone 40 has an open bottom of which the outermost portion is unoccluded to permit unobstructed fluid and solid flow. There is a central gas effluent 82 at the top of the disengaging zone 40 exiting vessel 50, said effluent 82 comprising the separated gas phase.

Located directly below disengaging zone 40 and also contained in vessel 50 is the stripping zone 45. Stripping zone 45 serves to vaporize the remaining liquid, which has migrated down from the disengaging zone 40. Stripping zone 45 has an inlet in open communication with the open bottom of the disengaging zone 40 and an outlet 80 for withdrawing catalyst particles from stripping zone 45. There is a means provided for adding stripping medium 85 to the stripping zone 45. The stripping medium 85 preferably comprises a stripping gas selected from the group consisting of steam, methane, propane, butane, natural gas, hydrogen, any gas with an affinity for hydrocarbons, and any combinations thereof. The delivery of stripping medium 85 is preferably performed in the stripping zone 45 below inclined baffles 90 (described later) at the bottom of vessel 50, The stripping medium may be fed in stripping zone 45 via one or more gas distributors (ring, nozzles—not illustrated) to distribute the flow of the stripping medium 85. The catalyst particles are contacted with incoming stripping medium 85 in stripping zone 45 and are stripped by said stripping medium 85 to remove any entrained or adsorbed hydrocarbons from the catalyst.

The stripping zone 45 and the disengaging zone 40 may each be housed in a separate vessel or, as shown in the embodiment of FIG. 1, may be integral with and housed in one single vessel 50.

Located within the stripping zone 45, there is a segregation zone comprising at least two inclined splash plates 88 spaced below the open bottom of the disengaging zone 40, preferably located below the cyclone hopper sections 78 at the base of cyclone diplegs 79. The inclined plates 88 typically provide an inclined surface to prevent the catalyst particles exiting cyclone hopper 79 to fall directly into outlet 80 of stripping zone 45. This diversion of the catalyst particles flow should increase the contact time with the stripping medium 85 so as to provide a more effective stripping of remaining liquid in droplet form and/or still adsorbed on catalyst particles.

Additionally, there is an arrangement of inclined baffles 90 within stripping zone 45 to direct the solid flow downward and the gas flow inward and upward. These inclined baffles 90 typically enhance the mixing of solid catalyst and stripping medium 85 in the stripping zone 45, and may be perforated so as to control gas and solid flows through them. The falling catalyst particles are guided downward and sideways with splash plates 88 and baffles 90, which in turn help to prevent re-entrainment of solid particles with any upward gas flow. A hopper (not shown) can be provided below the stripping zone outlet 80 to collect the solid. Preferably, greater than about 95 weight percent, more preferably greater than about 99 weight percent of the catalyst is separated in disengaging zone 40. The stripped separated catalyst, which has a low hydrocarbons content (i.e., less than 5 wt % hydrocarbons, preferably less than 2 wt % hydrocarbons, more preferably less than 1 wt % hydrocarbons), then exits vessel 50 via outlet 80 and can either await transport and/or be placed in a storage vessel, such as a hopper, a rail car, a barge, a truck trailer, and the like, to be sent to a reclamation process. The stripped separated exiting vessel 50 typically has a temperature between about 300° F. and about 350° F. The flow of catalyst exiting via outlet 80 can be controlled by a valve (not shown). Preferably, the stripped separated catalyst is collected into one of two or more hoppers. One hopper, when full is moved aside for cooling while a second hopper is loaded with the warm substantially hydrocarbon-free catalyst.

The stripped hydrocarbons in the stripping medium 85 rise and exit out the top of vessel 50 along with the cyclonic separation product vapors through vessel outlet 92 so that the recovered hydrocarbons and stripping medium 85 exit vessel 50 in effluent stream 82. Typically, the recovered hydrocarbons are cooled and may be condensed to a liquid state in downstrean equipment. Stream 82 may still comprise small amounts (i.e., preferably less than about 1,000 ppm solids) of carried-over solid catalyst, such as fines or small subparticles of size typically less than 5 microns, preferably less than 1 micron. Stream 82 can be subsequently filtered to remove any catalyst carryover, and the subsequently-filtered stream 82 comprising hydrocarbons may be sent to a refining unit for further processing and/or to a distillation unit for recovery of valuable hydrocarbons such as those comprised in middle distillate boiling range (i.e., diesel, jet fuel, and kerosene).

FIG. 2 illustrates a Fischer-Tropsch process 100 comprising Fischer-Tropsch reactor 110, and catalyst-hydrocarbon separation unit 115. Fischer-Tropsch reactor 110 preferably is a slurry bed reactor containing a slurry. The slurry without gas hold-up preferably comprises between 5 percent by weight (wt %) and about 40 wt % of solid catalyst in a liquid. The liquid in the slurry typically comprises a hydrocarbonaceous liquid, preferably comprises a mixture of hydrocarbonaceous compounds, more preferably comprises hydrocarbon products synthesized in said Fischer-Tropsch reactor 110.

A feedstream 120 comprising hydrogen ($H_2$) and carbon monoxide (CO) (the mixture thereof typically called synthesis gas or syngas) is fed at or near the bottom of Fischer-Tropsch reactor 110 through a gas distributor (not shown), thereby producing gas bubbles. The feed gas in addition of comprising reactant gases also serve as a fluidization gas for the solid catalyst in the slurry to maintain the catalyst particles suspended in the liquid so that to form an expanded slurry bed. As the gas bubbles rise through the reactor, the $H_2$ and CO reactants are absorbed into the liquid and diffuse to the Fischer-Tropsch catalyst where the reactants are converted under conversion promoting conditions to hydrocarbons (liquid and gaseous under said conversion promoting conditions) and water. At least a portion of the produced hydrocarbon gases, unconverted reactant gases and most of the water (as steam) enter the gas bubbles as they rise to the top of Fischer-Tropsch reactor 110 where they exit the reactor vessel via overhead gas stream 125.

At least a portion of the slurry comprising the Fischer-Tropsch catalyst and hydrocarbons exits the Fischer-Tropsch reactor 110 as reactor slurry stream 130 and is fed to external slurry circulation loop 135 as described earlier. Reactor slurry stream 130 may be passed through the optional gas-disengaging zone 140 and is passed through catalyst-hydrocarbon separation unit 115 so as to form hydrocarbon product stream 145 and solid-enriched slurry stream 148. Hydrocarbon liquid product stream 145 can subsequently be further refined and upgraded to high-value fuels, waxes, chemicals, chemical feedstocks and/or lubricating oils. Additionally, catalyst-hydrocarbon separation unit 115 may also serve as a degasser and remove any gas present in the slurry stream 130 that is then passed through stream 143 and is combined into gas effluent stream 125. Gas in gas effluent stream 125 may be recycled back to a gas plant (not shown) for further processing.

Fischer-Tropsch synthesis can produce a broad range of hydrocarbon products, comprising primarily of paraffins, olefins, and alcohols with carbon numbers ranging from 1 up to about 200. The hydrocarbon products present in slurry stream 130, and subsequently in hydrocarbon liquid product stream 145 are commonly referred to as synthetic waxes or wax product. Solid-enriched slurry stream 148 exiting catalyst-hydrocarbon separation unit 115 comprises at least some of the synthetic wax product.

In the preferred embodiment of this invention, the entire process 100 is pressure driven and therefore pumps are not required. Preferably the reactor 110 operates at about 375 to about 425 psia. Valves can be used to regulate the flow of slurry within external slurry circulation loop 135 and from external slurry circulation loop 135 into the catalyst recovery facility 10. Additionally, when facility 10 is not being utilized, a block valve could be used in stream 152 to isolate the facility 10, for example to purge the facility with a clean fluid.

In a preferred commercial embodiment, the process and system for catalyst recovery from a slurry containing said catalyst and residual hydrocarbons according to the present invention may be operated in a continuous mode, a batch mode, and combinations thereof. In continuous mode, a desired percentage of catalyst is continuously removed from an external slurry circulation loop 135 such as shown in FIG. 2 during operation of the Fischer-Tropsch reactor 110 (preferably a slurry bubble column reactor), and a like percentage of fresh catalyst is added to the reactor, so as to maintain catalyst inventory within Fischer-Tropsch reactor 110. While in continuous mode, a diverted portion of slurry stream 148 creates stream 152 for processing as described previously. In batch mode, flow is totally diverted from stream 148 (and optionally from stream 150 in reverse direction when emptying reactor 110) into stream 152 for processing, which typically occurs during shut down of Fischer-Tropsch reactor 110 to change out substantially all the catalyst. For example, at start up of a given Fischer-Tropsch reactor the catalyst is fresh and therefore the catalyst recovery facility 10 would not be utilized for that particular reactor for an initial time period. After operating the Fischer-Tropsch reactor 110 for a period of time, it may become desirable to begin continuously replacing a percentage of the catalyst, as at least a portion of the catalyst becomes deactivated or spent to the point where it no longer may be rejuvenated or regenerated. A desired amount of fresh catalyst is added while an equivalent amount of spent catalyst is removed and sent to the catalyst recovery facility 10 for processing to recover the spent catalyst. An intermediate storage vessel (not shown) for storage of a slurry comprising spent solid catalyst may be disposed between Fischer-Tropsch reactor 110 and facility 10 for minimizing reactor downtime versus the capacity of catalyst reclamation unit. The introduction to this intermediate storage vessel of a fluff gas or a fluidization gas preferably near or at the bottom of this vessel may be done so as to maintain the solid catalyst suspended in the liquid. Alternatively, the intermediate storage vessel may act as a settling vessel in which a slurry enriched in spent solid catalyst may be removed. After Fischer-Tropsch reactor 110 has been in operation for an additional period of time, the bulk of the catalyst in the slurry bed reactor becomes deactivated. At this point, the reactor is shut down and all of the spent catalyst is removed and sent to the catalyst recovery facility 10 for its recovery in a batch process. The reactor is subsequently loaded with fresh catalyst, and the Fischer-Tropsch process 100 is started up again.

In one alternative embodiment, a catalyst recovery facility 10 can be connected to multiple synthesis reactors, for example Fischer-Tropsch reactors 110. Therefore, overall plant operation can be continuous by scheduling only a single Fischer-Tropsch reactor to be shut down at a time for catalyst replacement and recovery while all other reactors are in operation. Operating in this manner would improve the economics for the catalyst recovery facility 10 according to the present invention.

In another alternative embodiment, the Fischer-Tropsch process 100 could employ a fixed bed reactor. The catalyst recovery system 10 as described herein could be used on the spent Fischer-Tropsch catalyst particles from the fixed bed reactor provided that additional means are employed to remove the spent catalyst from the fixed bed reactor. For example, upon freeing the catalyst within the fixed bed, an available solvent such as naphtha or diesel could be added to the spent catalyst to remove and wash out the spent catalyst from the Fischer-Tropsch fixed bed reactor and thus, form a slurry which can serve as feedstream (such as feedstream 56 or stream 52) to the catalyst recovery facility 10 as described previously in FIG. 1. Additionally, the catalyst recovery process 10 would need to be size adjusted accordingly to take into account the change in catalyst structure needed to accommodate fixed bed reactors, as the catalyst average particle size is usually bigger for a fixed bed reactor (typically greater than about 0.5 mm) than that for a slurry bed or slurry bubble column reactor (typically less than 0.25 mm). Initial reactor pressure may no longer be suitable to provide slurry flow from reactor 110 to heater 20, so pumps or other suitable transport means such as conveyors or augers may need to be utilized to supply the slurry feedstream to heater 20.

The separation process described in the embodiments above may be used to remove residual hydrocarbons from any suitable spent catalyst. In an embodiment shown in the figures, the catalyst described above is utilized in a hydrocarbon liquid synthesis process, preferably a Fischer-Tropsch process, to promote the conversion of CO and $H_2$ to one or more hydrocarbons.

FIG. 2 depicts a hydrocarbon liquid synthesis process, preferably a Fischer-Tropsch process, wherein the spent catalyst from the synthesis reactor 110 provides the feed for the catalyst recovery process 10 of the present invention. In a preferred embodiment shown in FIG. 2, at least a portion of the syngas feed 120 is provided by a partial oxidation (POX) reactor. In a more preferred embodiment, the POX reactor comprises a catalyst. A hydrocarbon feedstream comprising one or more alkanes, e.g., methane or natural gas, is fed to the POX reactor for conversion to syngas. The hydrocarbon feedstream may be a natural gas stream comprising alkanes such as methane, ethane, and propane. Alternatively, hydrocarbon feedstream may be a stream recovered from a gas plant (not shown) used to process natural gas into different fractions. Methane or other suitable hydrocarbon feedstreams (hydrocarbons with four carbons or less) are also readily available from a variety of other sources such as higher chain hydrocarbon liquids, coal, coke, hydrocarbon gases, etc., all of which are clearly known in the art. Preferably, the hydrocarbon feedstream to the POX reactor comprises essentially the methane fraction recovered from a gas plant processing natural gas. An oxygen-containing gas (e.g., pure oxygen, oxygen diluted with an inert gas, air, oxygen-enriched air, and so forth) is combined with the hydrocarbon feedstream and passed under conversion promoting conditions through the POX reactor so as to form a synthesis gas. The POX reactor is preferably a short contact time reactor (SCTR), e.g., a millisecond contact time reactor. The partial oxidation of the methane to syngas proceeds by the following exothermic reaction:

$$2CH_4+O_2 \rightarrow 2CO+4H_2$$

The conversion promoting conditions preferably includes a partial oxidation catalyst disposed within the POX reactor. The POX reactor contains any suitable catalyst for promoting the conversion of hydrocarbon gas to syngas. The POX catalyst comprises a wide range of catalytically active components, e.g., palladium, platinum, rhodium, iridium, osmium, ruthenium, nickel, chromium, cobalt, cerium, lanthanum, and mixtures thereof. A portion of or the totality of syngas stream 120 comprising $H_2$ and CO is recovered from the POX reactor.

Within the POX reactor, hydrocarbon feedstream comprising methane is contacted with the POX catalyst in a reaction zone that is maintained at conversion-promoting conditions effective to produce $H_2$ and CO. Preferably, the POX reactor is operated at such conditions to avoid the formation of unwanted by-products.

The gas hourly space velocity of the feedstream in the POX reactor can vary widely. Space velocities for the syngas production process via partial oxidation, stated as gas hourly space velocity (GHSV), are in the range of about 20,000 to about 100,000,000 $hr^{-1}$, more preferably of about 100,000 to about 10,000,000 $hr^{-1}$, still more preferably of about 100,000 to about 4,000,000 $hr^{-1}$, most preferably of about 400,000 to about 700,000 $hr^{-1}$. Although for ease in comparison with prior art systems space velocities at standard conditions have been used to describe the present invention, it is well recognized in the art that residence time is the inverse of space velocity and that the disclosure of high space velocities corresponds to low residence times on the catalyst. "Space velocity," as that term is customarily used in chemical process descriptions, is typically expressed as volumetric gas hourly space velocity in units of $hr^{-1}$. Under these operating conditions a flow rate of reactant gases is maintained sufficient to ensure a residence or dwell time of each portion of reactant gas mixture in contact with the catalyst of no more than 200 milliseconds, preferably less than 50 milliseconds, and still more preferably less than 20 milliseconds. A contact time less than 10 milliseconds is highly preferred. The duration or degree of contact is preferably regulated so as to produce a favorable balance between competing reactions and to produce sufficient heat to maintain the catalyst at the desired temperature. In order to obtain the desired high space velocities, the process is operated at atmospheric or superatmospheric pressures. The pressures may be in the range of about 100 kPa to about 32,000 kPa (about 1–320 atm), preferably from about 200 kPa to about 10,000 kPa (about 2–100 atm); more preferably from about 200 kPa to about 5,000 kPa (about 2–50 atm). The POX reactor which comprises a catalyst (CPOX) is preferably operated at a temperature in the range of about 350° C. to about 2,000° C. More preferably, the temperature is maintained in the range 400° C.–2,000° C., as measured at the CPOX reactor outlet. Additional description for operating a CPOX reactor is disclosed in co-owned U.S. Pat. Nos. 6,402,989; 6,409,940; 6,461,539; 6,630,078; 6,635,191; and U.S. published patent application 2002-0115730, each of which is incorporated herein by reference in its entirety.

In alternative embodiments, the POX reactor may be replaced with or supplemented by other syngas production units capable of converting a hydrocarbon gas feedstream (such as methane, ethane, or natural gas) to syngas, such as a steam reformer, a dry reformer and/or an auto-thermal reformer. Dry reforming entails reacting light hydrocarbons and carbon dioxide. Steam reforming (SR) entails endothermically reacting light hydrocarbons and steam over a catalyst contained within a plurality of externally heated tubes mounted in a furnace. Auto-thermal reforming (ATR) employs a combination of steam reforming and partial oxidation, i.e., reacting light hydrocarbons with oxygen and steam. More particularly, the endothermic heat required for the steam reforming reaction is obtained from the exothermic partial oxidation reaction. Suitable conditions for operating a steam reforming reactor and a dry reforming reactor are disclosed in V. R. Choudhary et al., in Catalysis Letters (1995) vol. 32, pp. 387–390; S. S. Bharadwaj & L. D. Schmidt in Fuel Process, Technol, (1995), vol. 42, pp.

109–127; and Y. H. Hu & E. Ruckenstein, in Catalysis Reviews—Science and Engineering (2002), vol. 44(3), pp. 423–453, each of which is incorporated herein by reference in its entirety.

The syngas stream 120 recovered from a syngas synthesis unit such as a POX reactor is fed to a synthesis reactor wherein the syngas is converted to a hydrocarbon liquid product such as Fischer-Tropsch products comprising mainly paraffins with some olefins and oxygenates, typically by contact with a synthesis catalyst. In a preferred embodiment shown in FIG. 2, the synthesis reactor 110 is a Fischer-Tropsch reactor containing any suitable Fischer-Tropsch catalyst for promoting the conversion of syngas to hydrocarbon liquids. In an alternative embodiment, synthesis reactor 10 is an alcohol synthesis reactor containing any suitable catalyst for promoting the conversion of syngas to one or more alcohols, preferably methanol.

In the Fischer-Tropsch reactor 110 embodiment, the syngas stream 120 is fed to a Fischer-Tropsch reactor 110 containing the Fischer-Tropsch catalyst to be recovered by the present invention, i.e., a metal catalyst activated by the partial reduction of metal oxide present on a catalyst support. The feed gases charged to the process of the invention comprise hydrogen, or a hydrogen source, and carbon monoxide. $H_2$/CO mixtures suitable as a feedstock for conversion to hydrocarbons according to the process of this invention can be obtained from light hydrocarbons such as methane by means of steam reforming, auto-thermal reforming, dry reforming, advanced gas heated reforming, partial oxidation, catalytic partial oxidation, or other processes known in the art. Alternatively, the $H_2$/CO mixtures can be obtained from biomass and/or from coal by gasification. In addition, the feed gases can comprise off-gas recycle from the present or another Fischer-Tropsch process. Preferably the hydrogen is provided by free hydrogen, although some Fischer-Tropsch catalysts have sufficient water gas shift activity to convert some water to hydrogen for use in the Fischer-Tropsch process. It is preferred that the molar ratio of hydrogen to carbon monoxide in the feed be greater than about 0.5:1 (e.g., from about 0.67:1 to about 2.5:1). Preferably, when cobalt, nickel, and/or ruthenium catalysts are used, the feed gas stream contains hydrogen and carbon monoxide in a molar ratio of about 1.4:1 to about 2.3:1. Preferably, when iron catalysts are used, the feed gas stream contains hydrogen and carbon monoxide in a molar ratio of about 1.4:1 to about 2.2:1. The feed gas may also contain carbon dioxide. The feed gas stream should not contain, or contain only in a very low concentration, compounds or elements that have a deleterious effect on the catalyst, such as poisons. For example, the feed gas may need to be pretreated to ensure that it contains no or alternatively very low concentrations of sulfur or nitrogen compounds such as hydrogen sulfide, ammonia and carbonyl sulfides.

During the Fischer-Tropsch process in which syngas stream 120 is fed to a Fischer-Tropsch reactor 110, the reaction zone contained in Fischer-Tropsch reactor 110 is maintained at conversion-promoting conditions effective to produce the desired hydrocarbon liquids. The Fischer-Tropsch process is typically run in a continuous mode. In this mode, the gas hourly space velocity through the reaction zone typically may range from about 50 to about 10,000 $hr^{-1}$, preferably from about 300 $hr^{-1}$ to about 2,000 $hr^{-1}$. The gas hourly space velocity is defined as the volume of reactants per time per reaction zone volume. The volume of reactant gases is at standard conditions of pressure (101 kPa) and temperature (0° C.). The reaction zone volume is defined by the portion of the reaction vessel volume where reaction takes place and which is occupied by a gaseous phase comprising reactants, products and/or inerts; a liquid phase comprising liquid/wax products and/or other liquids; and a solid phase comprising catalyst. The reaction zone temperature is typically in the range from about 160° C. to about 300° C. Preferably, the reaction zone is operated at conversion promoting conditions at temperatures from about 190° C. to about 260° C., more preferably from about 205° C. to about 230° C. The reaction zone pressure is typically in the range of from about 80 psia (552 kPa) to about 1000 psia (6895 kPa), more preferably from about 80 psia (552 kPa) to about 800 psia (5515 kPa), and still more preferably, from about 140 psia (965 kPa) to about 750 psia (5170 kPa). Most preferably, the reaction zone pressure is from about 250 psia (1720 kPa) to about 650 psia (4480 kPa).

Any suitable reactor configuration that allows contact between the syngas and the catalyst may be employed for Fischer-Tropsch reactor 110. The feed gas is contacted with the catalyst in a reaction zone. Mechanical arrangements of conventional design may be employed as the reaction zone including, for example, fixed bed, fluidized bed, slurry bubble column or ebulliating bed reactors, among others. Accordingly, the preferred size and physical form of the catalyst particles may vary depending on the reactor in which they are to be used. Most preferably, Fischer-Tropsch reactor 110 comprises a slurry bubble column reactor loaded with solid catalyst particles comprising cobalt and/or ruthenium with optional promoters. The solid catalyst particles may have a size varying from sub-micron up to about 250 microns, but preferably 90 percent by weight of the particles should have a size between about 10 and 150 microns. The solid catalyst particles should have a weight average size between about 30 microns and 150 microns, preferably between about 40 microns and 100 microns, more preferably between about 60 microns and 90 microns.

Fischer-Tropsch catalysts are well known in the art and generally comprise a catalytically active metal, a promoter and optionally a support structure. The most common catalytic metals are Group 8, 9 and 10 metals of the Periodic Table (new IUPAC Notation), such as cobalt, nickel, ruthenium, and iron or mixtures thereof. The preferred metals used in Fischer-Tropsch catalysts with respect to the present invention are cobalt, iron and/or ruthenium, however, this invention is not limited to these metals or the Fischer-Tropsch reaction. Other suitable catalytic metals include Groups 8, 9 and 10 metals. The promoters and support material are not critical to the present invention and may be comprised, if at all, by any composition known and used in the art. Promoters suitable for Fischer-Tropsch synthesis may comprise at least one metal from Group 1, 7, 8, 9, 10, 11, and 13. When the catalytic metal is cobalt, the promoter is preferably selected from the group consisting of ruthenium (Ru), platinum (Pt), palladium (Pd), rhenium (Re), boron (B), silver (Ag), and combinations thereof. When the catalytic metal is iron, the promoter is preferably selected from the group consisting of lithium (Li), copper (Cu), potassium (K), silver (Ag), manganese (Mn), sodium (Na), and combinations thereof. The preferred support composition when used preferably comprises an inorganic oxide selected from the group consisting of alumina, silica, titania, zirconia and mixtures thereof. The inorganic oxide is preferably stabilized by the use of a structural promoter or stabilizer, so as to confer hydrothermal resistance to the support and the catalyst made therefrom.

In preferred embodiments, Fischer-Tropsch process 100 comprises one or more hydrocarbon synthesis reactors and each reactor comprises a slurry bubble column operated with particles of a cobalt catalyst.

In a slurry-bubble reactor, the Fischer-Tropsch catalyst particles are suspended in a liquid, e.g., molten hydrocarbon wax, by the motion of bubbles of syngas sparged into the bottom of the reactor. As the gas bubbles rise through the reactor, the syngas is absorbed into the liquid where it diffuses to the catalyst for conversion to hydrocarbons. Gaseous products enter the gas bubbles and are collected at the top of the reactor. Liquid products are recovered from the suspended liquid using different techniques such as filtration, settling, hydrocyclones, and magnetic techniques. Cooling coils immersed in the slurry remove heat generated by the reaction.

Alternatively, Fischer-Tropsch reactor 110 can be a fixed bed reactor comprising a Fischer-Tropsch catalyst bed. The syngas flowing through the Fischer-Tropsch catalyst bed contacts the Fischer-Tropsch catalyst. The reaction heat is typically removed by passing a cooling medium through cooling tubes disposed within said fixed bed reactor.

In Fischer-Tropsch reactor 110, $H_2$ and CO combine in a polymerization-like fashion to form hydrocarbon compounds having varying numbers of carbon atoms. The hydrocarbon compounds are typically separated by boiling point into three fractions (two liquid and one gas), with each stream having the majority of the hydrocarbons falling within a given range of carbon atoms. Generally, the higher the boiling point, the higher the wax content of the stream. Stream 54 of FIG. 1 may be one of these fractions or any combination of two fractions. The first fraction is a light liquid hydrocarbon fraction comprising liquid intermediate compounds, such as synthetic crude or paraffinic liquids having about five to about seventeen carbon atoms. The second fraction is a heavy liquid hydrocarbon fraction comprising semi-solid heavy compounds, such as waxy hydrocarbons having greater than about seventeen carbon atoms. The third fraction which is typically produced by Fischer-Tropsch reactor 110 is a light off gas stream 125 comprising various components, such as water vapor, $CO_2$, unreacted $H_2$ and CO, and light hydrocarbons having about one to about six carbon atoms. Light off gas stream 125 can be processed as needed (e.g., water removal) and recycled to the gas plant (not shown).

Light hydrocarbon fraction and heavy hydrocarbon fraction may be fed to an upgrading/refining process to form additional valuable products, such as liquid fuels, lubricating oils, and/or waxes. The upgrading/refining process preferably includes a hydrotreater and/or a hydrocracker for upgrading heavy hydrocarbon fraction, The long-chain hydrocarbon waxes typically mainly present in heavy hydrocarbon fraction are subjected to hydrogenation in the hydrotreater and chain shortening by hydrocracking in the presence of a catalyst and $H_2$ in the hydrocracker, thereby converting long-chain hydrocarbon waxes to shorter-chain hydrocarbons boiling in middle distillate range. The hydrocracker effluent can be further fractioned to form product distillate streams, such as a naphtha stream, a kerosene stream, and a diesel stream. The naphtha, kerosene, and diesel streams are essentially free of sulfur (i.e., less than 10 ppm S, preferably less than 5 ppm S, more preferably less than 1 ppm S) and thus may be used to produce environmentally friendly low sulfur liquid fuels. The naphtha can be used as a chemical feedstock to make olefins.

The approach used in the present invention to recover a catalyst for reclamation provides several advantages. As mentioned previously, an important economic advantage is that removal of substantially all waxy hydrocarbons from the catalyst reduces the total weight and bulk of the product to be shipped, thereby reducing the cost associated with transporting the recovered catalyst. Additionally, recovering the hydrocarbons in the catalyst slurry and processing them for sale is another economic advantage. Catalyst that is substantially free of hydrocarbons is easier to handle from a health and safety perspective and easier to dispose of in an environmentally sound manner. Furthermore, the method of the present invention uses streams within the facility that are readily available and have low value under normal operation, i.e., overhead gas, off gas, and naphtha. Moreover, the heating provided in heater 20 can provide cracking promoting conditions so as to thermally crack some of the waxy hydrocarbons to form valuable hydrocarbons boiling in the middle distillate range, which can be recovered from effluent 82 of vessel 50.

While the preferred embodiments of the invention have been shown and described, modifications thereof can be made by one skilled in the art without departing from the spirit and teachings of the invention. Reactor design criteria, pendant hydrocarbon processing equipment, and the like for any given implementation of the invention will be readily ascertainable to one of skill in the art based upon the disclosure herein. The embodiments described herein are exemplary only, and are not intended to be limiting. Many variations and modifications of the invention disclosed herein are possible and are within the scope of the invention. Use of the term "optionally" with respect to any element of a claim is intended to mean that the subject element is required, or alternatively, is not required. Both alternatives are intended to be within the scope of the claim.

Accordingly, the scope of protection is not limited by the description set out above, but is only limited by the claims which follow, that scope including all equivalents of the subject matter of the claims. Each and every claim is incorporated into the specification as an embodiment of the present invention. Thus the claims are a further description and are an addition to the preferred embodiments of the present invention. The discussion of a reference in the Description of Related Art is not an admission that it is prior art to the present invention, especially any reference that may have a publication date after the priority date of this application. The disclosures of all patents, patent applications, and publications cited herein are hereby incorporated by reference, to the extent that they provide exemplary, procedural or other details supplementary to those set forth herein.

What is claimed is:

1. A process for recovering a solid catalyst from a catalyst slurry comprising residual hydrocarbons, said process comprising:

(a) providing a catalyst slurry feedstream comprising catalyst particles and residual hydrocarbons;

(b) passing said catalyst slurry feedstream through a heater so as to vaporize a substantial portion of the residual hydrocarbons;

(c) conveying the heated slurry feedstream comprising vaporized hydrocarbons and catalyst particles in a riser to a disengaging zone;

(d) separating substantially most of the catalyst particles from the vaporized hydrocarbons in the disengaging zone;

(e) providing a stripping zone in fluid communication with the disengaging zone, said stripping zone suitably located so as to receive the separated catalyst particles of step (d) from the disengaging zone;

(f) supplying a stripping medium in the stripping zone;

(g) contacting the separated catalyst particles in the stripping zone with the stripping medium to remove some strippable hydrocarbons remaining after separation step (d) from the separated catalyst particles to produce stripped catalyst particles;

(h) recovering an effluent stream comprising vaporized hydrocarbons, strippable hydrocarbons, and stripping medium from the disengaging zone; and (i) recovering the stripped catalyst particles from the stripping zone.

2. The process of claim 1 wherein providing the catalyst slurry feedstream in step (a) comprises withdrawing a slurry stream from a slurry bubble column reactor containing a catalyst slurry.

3. The process of claim 2 wherein providing the catalyst slurry feedstream in step (a) comprises one step selected from the group consisting of:

passing the slurry stream from a slurry bubble column reactor through a liquid-liquid extraction unit;

passing the slurry stream from a slurry bubble column reactor through a solid-liquid separation unit;

passing a slurry stream from a liquid-liquid extraction unit through a solid-liquid separation unit;

passing a slurry stream from a solid-liquid separation unit through a liquid-liquid extraction unit; and any combination of two steps or more thereof;

so as to provide at least a portion of the catalyst slurry feedstream of step (a), wherein the so-formed portion of the catalyst slurry feedstream of step (a) has a different composition from that of the withdrawn slurry stream from the slurry bubble column reactor.

4. The process of claim 3 wherein passing through the liquid-liquid extraction unit comprises contacting the slurry stream with an extraction liquid selected from the group consisting of a diesel, a naphtha, a gasoline, a kerosene, a gas oil, a heating oil, a solvent, and any combination thereof.

5. The process of claim 4 wherein the extraction liquid comprises a synthetic diesel, a synthetic naphtha, or any combination thereof.

6. The process of claim 3 wherein the solid-liquid separation unit comprises filtration decantation, sedimentation, centrifugation, magnetic separation, or any combination thereof.

7. The process of claim 6 wherein the filtration comprises a rotary drum filter, a cross-flow filter, a cake filter, or any combination thereof.

8. The process of claim 3 wherein the different composition comprises a different catalyst content, a different residual hydrocarbons content, or any combination thereof.

9. The process of claim 2 wherein step (a) further comprises adding a diluting light stream comprising hydrocarbons, said hydrocarbons having a boiling point ranging from about 250° F. to about 650° F., to the slurry bubble column reactor containing the catalyst slurry, while cooling the slurry bubble column reactor, and withdrawing a diluted slurry stream from the slurry bubble column reactor when a reactor temperature below about 10° F. is reached, so as to provide at least a portion of the catalyst slurry feedstream of step (a).

10. The process of claim 9 wherein the diluting light stream comprises a synthetic diesel, a synthetic naphtha, or any combination thereof.

11. The process of claim 1 wherein the catalyst comprises a Fischer-Tropsch catalyst.

12. The process of claim 1 wherein the catalyst comprises a metal or metal oxide.

13. The process of claim 1 wherein the catalyst comprises cobalt, ruthenium, or any combination thereof.

14. The process of claim 1 wherein the catalyst comprises cobalt and another element selected from the group consisting of silver, platinum, rhenium, boron, ruthenium, and combinations thereof.

15. The process of claim 1 wherein the residual hydrocarbons comprise waxy hydrocarbons.

16. The process of claim 15 wherein the waxy hydrocarbons comprise hydrocarbons having equal to or greater than about ten carbon atoms.

17. The process of claim 1 further comprising diluting the catalyst slurry feedstream with additional hydrocarbons.

18. The process of claim 17 wherein the additional hydrocarbons comprise hydrocarbons having equal to or greater than about ten carbon atoms.

19. The process of claim 17 wherein the additional hydrocarbons comprise Fischer-Tropsch hydrocarbon product.

20. The process of claim 19 wherein the Fischer-Tropsch hydrocarbon product is provided from a slurry bubble reactor.

21. The process of claim 17 wherein the additional hydrocarbons are provided at a temperature of from about 200 to about 550° F.

22. The process of claim 1 further comprising thermally cracking a portion of the residual hydrocarbon during or after vaporization thereof.

23. The process of claim 22 wherein the thermal cracking takes place during step (b), during step (c), or during both steps (b) and (c).

24. The process of claim 1 wherein the catalyst slurry feedstream is heated to from about 400 to about 950° F. to vaporize substantially most of the hydrocarbons.

25. The process of claim 1 wherein substantially all of the residual hydrocarbons in the slurry are vaporized.

26. The process of claim 25 wherein the catalyst slurry feedstream is heated to from about 700 to about 950° F. to vaporize substantially all of the hydrocarbons.

27. The process of claim 1 wherein the heater in step (b) is fueled by a gas stream selected from the group consisting of natural gas; methane; ethane; propane; a gas effluent from a Fischer-Tropsch reactor, from a hydroprocessing unit, or from a fractionation column; and any combination thereof.

28. The process of claim 1 wherein the riser comprises a gas velocity of from about 20 ft/sec to about 500 ft/sec.

29. The process of claim 1 wherein the riser comprises a gas velocity of from about 30 ft/sec to about 200 ft/sec.

30. The process of claim 1 further comprising adding a supplemental transport medium to the riser to facilitate conveying the vaporized hydrocarbons and catalyst particles in the riser.

31. The process of claim 30 wherein the supplemental transport medium comprises liquid petroleum gas (LPG); hydrogen; steam; natural gas; any gaseous alkane; a tail gas from a Fischer-Tropsch reactor, from a hydroprocessing unit; a gaseous fraction from a fractionation column; or any combination thereof.

32. The process of claim 30 wherein the supplemental transport medium comprises hydrogen, steam, or any combination thereof.

33. The process of claim 1 wherein the catalyst particles are separated from the vaporized hydrocarbons in the disengaging zone via at least one cyclone.

34. The process of claim 33 wherein the catalyst particles separate from the vaporized hydrocarbons and settle in a cyclone hopper.

35. The process of claim 1 wherein substantially all the catalyst particles are separated from the vaporized hydrocarbons.

36. The process of claim 1 wherein the stripping medium comprises a stripping gas selected from the group consisting of steam, methane, propane, butane, natural gas, hydrogen, and any combination thereof.

37. The process of claim 1 wherein the stripping medium comprises steam, hydrogen, or any combination thereof.

38. The process of claim 1 wherein the stripping zone is disposed below the disengaging zone.

39. The process of claim 38 wherein the disengaging zone and the stripping zone are disposed within a single vessel.

40. The process of claim 39 wherein the effluent stream comprising vaporized hydrocarbons, strippable hydrocarbons, and the stripping medium exits the disengaging zone at the top of the vessel.

41. The process of claim 1 further comprising passing the effluent stream from the disengaging zone through a filtering unit so as to remove any catalyst particles carried over in said effluent.

42. The process of claim 1 further comprising passing the effluent stream from the disengaging zone to a refining unit for further processing of hydrocarbons contained in said effluent stream.

43. The process of claim 1 further comprising recovering the stripped catalyst particles from the stripping zone into a storage container, a transport container, or combination thereof.

44. The process of claim 1 wherein the catalyst slurry feedstream is provided from one or more reactors.

45. The process of claim 1 wherein the catalyst slurry feedstream is provided from at least one storage tank comprising a slurry from one or more reactors.

46. An integrated process for producing hydrocarbons and recovering spent solid catalyst, comprising:

(a) contacting a solid synthesis catalyst with a feedstream comprising carbon monoxide and hydrogen in a reaction zone under conversion promoting conditions so as to produce one or more hydrocarbons, while a deactivation of said solid synthesis catalyst takes place over time within said reaction zone and creates a spent solid synthesis catalyst;

(b) removing all or a portion of the solid synthesis catalyst from the reaction zone so as to generate a slurry feedstream comprising spent solid synthesis catalyst and residual hydrocarbons;

(c) optional adjusting the hydrocarbon composition of said slurry feedstream, the catalyst content of said slurry feedstream, or both;

(d) passing said slurry feedstream through a heater so as to vaporize a substantial portion of the residual hydrocarbons;

(e) conveying the heated slurry feedstream comprising vaporized hydrocarbons and catalyst particles in a riser to a disengaging zone;

(f) separating substantially most of the solid catalyst from the vaporized hydrocarbons in the disengaging zone;

(g) providing a stripping zone in fluid communication with the disengaging zone, said stripping zone suitably located so as to receive the separated solid catalyst of step (f) from the disengaging zone;

(h) supplying a stripping medium in the stripping zone;

(i) contacting the separated solid catalyst in the stripping zone with the stripping medium to remove some strippable hydrocarbons remaining after separation step (f) from the separated solid catalyst to produce stripped solid catalyst;

(j) recovering an effluent stream comprising vaporized hydrocarbons, strippable hydrocarbons, and stripping medium from the disengaging zone; and (k) recovering the stripped solid catalyst from the stripping zone.

47. The process of claim 46 wherein the reactor zone comprises a slurry bed reactor.

48. The process of claim 47 wherein step (b) is performed from a catalyst recirculation loop from the slurry bed reactor.

49. The process of claim 46 herein the process further includes (l) replacing the removed solid catalyst with fresh solid catalyst.

50. The process of claim 46 wherein the solid catalyst comprises a metal, metal oxide, or any combination thereof.

51. The process of claim 46 herein the solid catalyst comprises cobalt, ruthenium, or any combination thereof.

52. The process of claim 46 wherein the catalyst comprises cobalt, and further comprises another element selected form the group consisting of silver, platinum, rhenium, boron, ruthenium, or any combination thereof.

* * * * *

UNITED STATES PATENT AND TRADEMARK OFFICE

CERTIFICATE OF CORRECTION

PATENT NO. : 6,974,842 B1
DATED : December 13, 2005
INVENTOR(S) : Michael D. Spena et al.

It is certified that error appears in the above-identified patent and that said Letters Patent is hereby corrected as shown below:

Column 23,
Line 65, "10°F." should read -- 100°F. --.

Signed and Sealed this

Fourteenth Day of February, 2006

JON W. DUDAS
*Director of the United States Patent and Trademark Office*